US005860226A

United States Patent [19]

Graham et al.

[11] Patent Number: 5,860,226

[45] **Date of Patent: *Jan. 19, 1999**

[54] SHOE CONSTRUCTION

[75] Inventors: Kenneth D. Graham, Stoneham; Stephen Francis, Newburyport; Michael Kirk, Swampscott, all of Mass.

[73] Assignee: Hyde Athletic Industries, Inc., Peabody, Mass.

[ * ] Notice: The portion of the term of this patent subsequent to Apr. 4, 2012, has been disclaimed.

[21] Appl. No.: 782,560

[22] Filed: Jan. 10, 1997

Related U.S. Application Data

[63] Continuation of Ser. No. 415,860, Apr. 3, 1995, abandoned, which is a continuation of Ser. No. 659,874, Feb. 25, 1991, Pat. No. 5,402,588, which is a continuation-in-part of Ser. No. 427,764, Oct. 26, 1989, Pat. No. 5,070,629.

[51] Int. Cl.[6] ..... A43B 13/18; A43B 13/16

[52] U.S. Cl. ..... 36/28; 36/114; 36/27

[58] Field of Search ..... 36/69, 28, 114, 36/38, 103, 35 R, 27, 112; 359/802, 798, 799, 800, 801, 870, 442

[56] References Cited

U.S. PATENT DOCUMENTS

| | | | |
|---|---|---|---|
| 465,513 | 12/1891 | Applegate | 359/810 |
| 658,234 | 9/1900 | Carter . | |
| 2,011,945 | 8/1935 | Mathi . | |
| 2,735,185 | 2/1956 | Naphtal | 359/442 |
| 3,332,262 | 7/1967 | Schillizzi | 359/809 |
| 4,506,460 | 3/1985 | Rudy . | |
| 4,510,700 | 4/1985 | Brown . | |
| 4,534,121 | 8/1985 | Autry . | |
| 4,541,184 | 9/1985 | Leighton . | |
| 4,597,196 | 7/1986 | Brown . | |
| 4,619,056 | 10/1986 | Lin et al. . | |
| 4,638,576 | 1/1987 | Papracho et al. . | |
| 4,709,489 | 12/1987 | Wecter . | |
| 4,712,314 | 12/1987 | Sigoloff | 36/112 |
| 4,757,616 | 7/1988 | Hills . | |
| 4,878,300 | 11/1989 | Bogaty | 36/35 R |
| 4,878,301 | 11/1989 | Kiyosawa . | |
| 4,879,821 | 11/1989 | Graham et al. . | |
| 4,918,841 | 4/1990 | Turner | 36/28 |
| 4,970,807 | 11/1990 | Anderie et al. | 36/28 |
| 4,974,345 | 12/1990 | Yung-Mao | 36/28 |
| 5,070,629 | 12/1991 | Graham et al. . | |
| 5,084,987 | 2/1992 | Flemming . | |
| 5,402,588 | 4/1995 | Graham et al. | 36/28 |
| 5,503,576 | 4/1996 | Brown . | |

FOREIGN PATENT DOCUMENTS

| | | | |
|---|---|---|---|
| 8905593 | 6/1989 | WIPO . | |
| 9115973 | 10/1991 | WIPO | 36/28 |

*Primary Examiner*—Ted Kavanaugh
*Attorney, Agent, or Firm*—Wolf, Greenfield & Sacks, P.C.

[57] ABSTRACT

A shoe construction having an energy return system together with features providing cushioning and stability. The energy return system includes a rigid frame having annular walls in the forefoot and heel areas of the midsole. An outersole defines an opening that is co-extensive with the open area in the midsole. A transparent plastic window is positioned in this opening for magnifying the net from below.

8 Claims, 3 Drawing Sheets

SHOE CONSTRUCTION

This application is a File Wrapper Continuation of application Ser. No. 08/415,860, filed Apr. 3, 1995 now abandoned, which is a Continuation under 37 C.F.R. 1.60 of Ser. No. 07/659,874, filed Feb. 25, 1991, now U.S. Pat. No. 5,402,588, dated Apr. 4, 1995, which is a Continuation-in-Part of Ser. No. 07/427,764, filed Oct. 26, 1989, now U.S. Pat. No. 5,070,629, dated Dec. 10, 1991.

SUBJECT MATTER OF INVENTION

The present invention relates to a shoe construction and more particularly to a shoe having means for imparting energy return characteristics to the shoe.

BACKGROUND OF INVENTION

There has been recent interest in improving performance characteristics of athletic and walking shoes. Initially these efforts were primarily directed to improving cushioning and shock absorption. Improvement of these characteristics was materially assisted with the development of a range of synthetic materials particularly useful in footwear manufacture. Most recently, microcellular closed cell material of selected compressibilities such as ethylene vinyl acetate (EVA) and improved polyurethane systems has been used in the commercial manufacture of a variety of midsole and wedge components intended to improve the comfort, cushioning and shock absorption of footwear. Commercially available footwear using such material now include components to improve the stability and bio-mechanics of the footwear. Such components as motion control devices and torsional rigidity bars are also now common components in such commercial products.

The most recent industry interest relates to the manufacture of footwear having energy return characteristics. This interest has also been enhanced by the common availability of EVA and other microcellular foam materials for use as resilient cushioning material. Such material has the characteristic of absorbing energy in the compression phase of a gait cycle and releasing the energy as the compression is released. The absorbed energy is released in the push-off phase of the gait cycle in running or walking.

Other energy return systems have contemplated the use of thermoplastic hollow tubes or shapes encapsulating a fluid or gas such as a Freon. These encapsulations are strategically located in the midsole or elsewhere to provide an energy return mechanism to the shoe.

Still other systems contemplate the use of such commercially available materials as Hytrel and Kevlar in various blends, compositions and molded arrangements positioned in the arch and/or medial portion of the shoe providing mechanical cushioning and energy storage.

There has been some use of netting or mesh arrangements in selected portions of a sole construction for various purposes. Insofar as the applicant is aware, the earliest of such efforts was in the form of a fine woven wire fabric described in U.S. Pat. No. 812,496 issued Feb. 13, 1906. Mesh used in that construction, however, provided only stiffness and wearing qualities at the bottom of the heel. That patent failed to suggest arranging the mesh under appropriate tension and thus fails to teach or suggest the use of such mesh in an energy return system.

A second disclosure of a mesh construction is contained in U.S. Pat. No. 1,650,466 issued Nov. 22, 1927. In that construction, a fabric of mesh is used to retain the shape of a component and does to act as an energy return system such as a spring or the like.

Most recently, U.S. Pat. No. 4,297,796 issued Nov. 3, 1981, discloses the use of an open work support or netting of stretch resistant threads secured to the top side of a flexibly deformable sole layer. This netting structure is intended to distribute shock stresses in the heel or ball of the foot. Since that open mesh is three-dimensional, it redistributes deformation of the sole structure under compression and does not function as a spring-like energy return system.

Similarly, a more recent disclosure in U.S. Pat. No. 4,608,768 issued Sep. 2, 1986 discloses the use of an open work structure embedded in a resilient member with plugs arranged within the openings of the open work structure. In such an arrangement, different shock absorbing characteristics may be imparted to selected portions of the sole structure. The mesh arrangement, itself, however does not appear to be used as a spring-like energy return system.

Other references in which various midsole structures having related arrangements include, U.S. Pat. Nos. 3,808,713, 4,179,826, 4,263,728, 4,451,994, 4,507,879, 4,566,206, 4,753,021, and 4,774,774.

Insofar as the applicant is aware, no efforts have been made to use a mesh or net-like structure as a means for imparting energy return characteristics in footwear. Prior efforts directed toward energy return systems have, insofar as the applicant is aware, centered upon the use of macro and microcellular structures in which energy is stored in a fluid system under compression and thereafter released during expansion of the fluid component. Such arrangements have a variety of limitations. Nor is applicant aware of using a mesh-like arrangement in combination with a frame shaped to provide added functions and features including cushioning and stability.

The commercial embodiments of footwear containing energy return systems have also been cosmetically enhanced with several mechanisms intended to visually enhance these energy return systems to make them commercially attractive. In some cases, these efforts have taken the form of openings or windows on the sides of the shoes which permit visual inspection of a profile of the energy return system. In other instances, these side openings are covered with transparent windows. In still other instances, the energy return systems are made of a transparent material. The commercial systems that are available today do not, however, generally provide a sealed visual system that permits inspection of the energy return systems from the inside or bottom of the shoe.

SUMMARY OF INVENTION

It is an object of the present invention to provide an improved and alternate means for imparting energy return characteristics to a shoe.

A further object of the present invention is to provide an improved shoe construction particularly useful for athletic activities that incorporates a spring-like system in selected areas of the heel and forefoot portion for purposes of storing energy in running and/or jumping during compression portions of the gait cycle and for releasing energy during the push-off phase of the gait cycle.

A further object of the present invention is to provide an improved energy return system for footwear which does not require the use of currently popular gas or fluid filled tubes or chambers.

A further object of the present invention is to provide a footwear construction with energy return characteristic that may be used in a wide range of footwear, including shoes designed for walking and various sporting activities, such as running, basketball, aerobics and the like.

Another object of the present invention is to provide an improved energy return system for use in footwear constructions that can be specifically tuned to meet particular needs of individuals and particular requirements of different sporting activities.

A further object of the present invention is to provide an improved energy return system incorporated into a shoe that reduces the weight of the shoe by eliminating a portion of the midsole material.

Still another object of the present invention is to provide an energy return system for footwear which may be visibly incorporated into shoes to enhance the marketability of the footwear.

One further object of the present invention is to provide an energy return system for footwear which is visible through transparent openings in the midsole and outer sole with these openings vertically aligned.

A further object of the present invention is to provide a window through which the energy return system components may-be viewed from either the bottom or top of the shoe in the heel region and in which the shape and performance of the energy return system may be tactically examined.

A still further object of the present invention is to provide a window-like opening in the outer sole of the shoe for visual inspection of an energy return system contained in the sole structure with a window-like opening including a magnifying lens to enhance and enlarge the image of the energy return system components.

One more object of the present invention is to provide an energy return system for footwear that is readily manufactured to consistent standards.

A further object of the present invention is to provide an energy return system in which the compression set of the midsole component is minimized by shaping the system to assure the uniform distribution of forces on the components and to minimize internal friction.

Another object of the present invention is to provide an improved energy return system in the form of a mesh or net secured under tension in a plane parallel to the sole and over an open or void area in the heel and forefoot portion of the sole structure for energy storage during heel engagement and push-off in the gait cycle as well as in jumping and/or running.

One more advantage of the present invention is to provide an improved energy return system that incorporates a frame supporting mesh or net components, both in the heel and forepart region of the shoe. Such mesh or net components are maintained under tension to impart spring-like qualities which absorb energy during compression and release it during the push-off portion of the gait cycle.

DETAILED DESCRIPTION OF DRAWINGS

These and other objects and advantages of the present invention will be more clearly understood when considered in conjunction with accompanying drawings in which.

DETAILED DESCRIPTION OF A PREFERRED EMBODIMENT

The energy return system of the present invention includes the use of components in the midsole region which provide both cushioning and energy return characteristics. These components may be selectively embodied in the heel, midfoot and/or forepart of the midsole to achieve desired energy return characteristics designed for a particular type of shoe. Thus components may be especially designed for use in walking shoes or various specific types of athletic shoes such as basketball or running shoes.

While the invention contemplates, in its broadest sense, components embodied in the heel, mid-foot and fore part, the specific embodiments referred to in the exemplifications of this application are directed to a preferred structure embodied in the heel. Modifications in the mid-foot and fore foot, however, are described in the application of which this a continuation in part.

Figure 1:
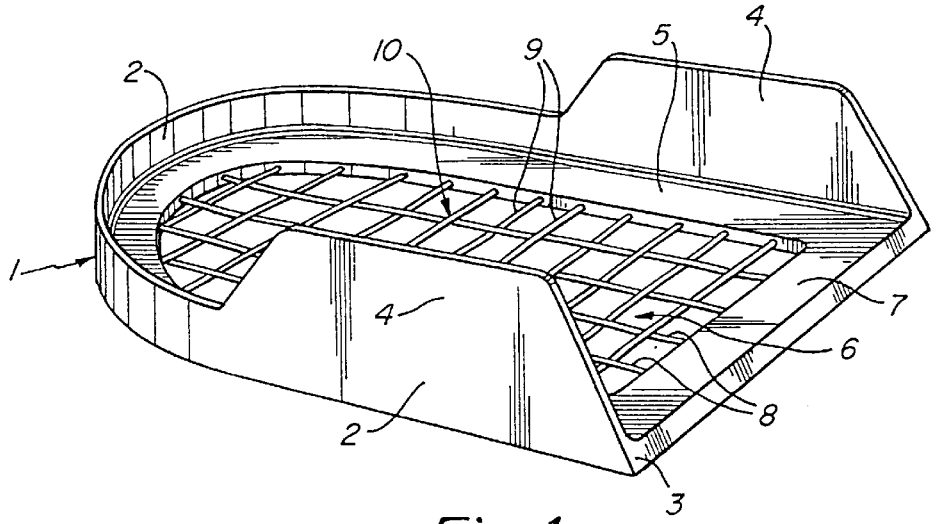
FIG. 1 is a perspective view of a rigid heel frame embodying components of the invention.

Referring first to the embodiment illustrated in FIG. 1, there is illustrated a rigid frame 1 designed to be incorporated in a midsole construction. This rigid frame 1 is shaped to fit in the heel region of the shoe preferably above and permanently secured to a midsole member (not shown). The frame 1 is a stabilizing member having an upwardly extending flange or sidewall 2 about its periphery from the lateral side, extending about the heel forwardly to the forward portion of the heel on the medial side at the arch area 3. The upwardly extending flange 2 has a greater height along a length 4 at its forward ends defining motion control device that is intended to impart greater stability to the heel. An inwardly extending flange 5 is continuous with the lower edge of the upwardly extending flange 2, defining an open area 6. The forward end of the open area 6 is defined by a lateral flange 7 which is continuous with the forward ends of flange 5. A plurality of fibers 8 and 9, which may be of nylon or other suitable filaments used for tennis racquets, are woven into a grid or net positioned in the plane of the flanges 5 and 7. The fibers 8 and 9 have their respective ends anchored and suitably locked into the frames 5 and 7 so that the grid or net 10 is taut and thereby forms a spring-like member which is highly resilient. The ends of the fibers 8 and 9 may be suitably locked to the rigid frame by suitable means. For example, the fibers 8 and 9 may be enlarged, bent or knotted at the ends before being positioned in a mold from which the rigid frame is formed. The fibers should not have any slack. Alternately, the ends may be ultrasonically or otherwise welded to the frame. In this procedure the frame is formed with an upper and lower half between which is sandwiched the preassembled mesh with its ends lying in aligned grooves in the facing surfaces of the two halves. The unit is ultrasonically welded together in a suitable sequence as a sandwich. The rigid frame 1 is thus molded with the enlarged ends of the fibers 8 and 9 molded into the flanges 5 and 7 as illustrated. As an alternative means, the fibers 8 and 9 may be molded simultaneously with the frame.

The frame 1 must be made a of a stiff or semi-resilient material to permit the frame and the fibers be maintained under taut conditions. Under some conditions the fibers may be maintained under tension. This frame may be compounded from a variety of plastic such as high impact thermosetting plastic or in combination with material such as commercially available Kevlar. The fibers may be formed of a reinforced material or material having significant tensile strength characteristics, such as nylon monofilament or boron or graphite composite filaments in order to achieve both characteristics of stability and shock attenuation.

Figure 2:
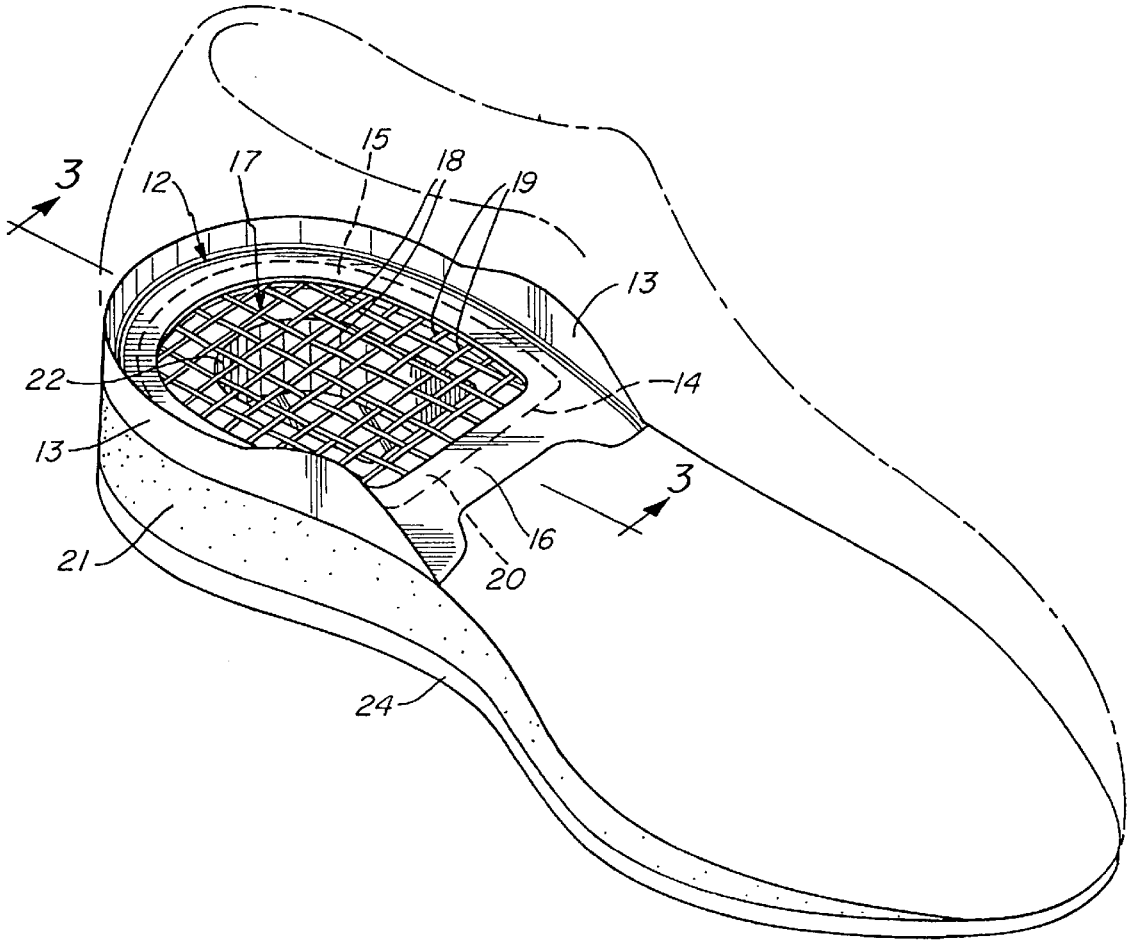
FIG. 2 is a perspective view of a heel component illustrating another embodiment of the invention.

FIG. 2 illustrates a preferred embodiment of the invention with the location of the energy return system illustrated by a dotted outline of the shoe upper. In this embodiment, a modified rigid frame 12 is formed with an upwardly extending flange or sidewall 13 that extends about the rear of the heel forwardly to the arch area to provide motion control and stabilization to the heel. The frame 12 is formed with a recess in its lower surface defined by the dotted line 14 and having a heel-like shape. This recess 15 is located in the lower surface of the inwardly extending flange or base 16 of the frame 12.

Figure 3:
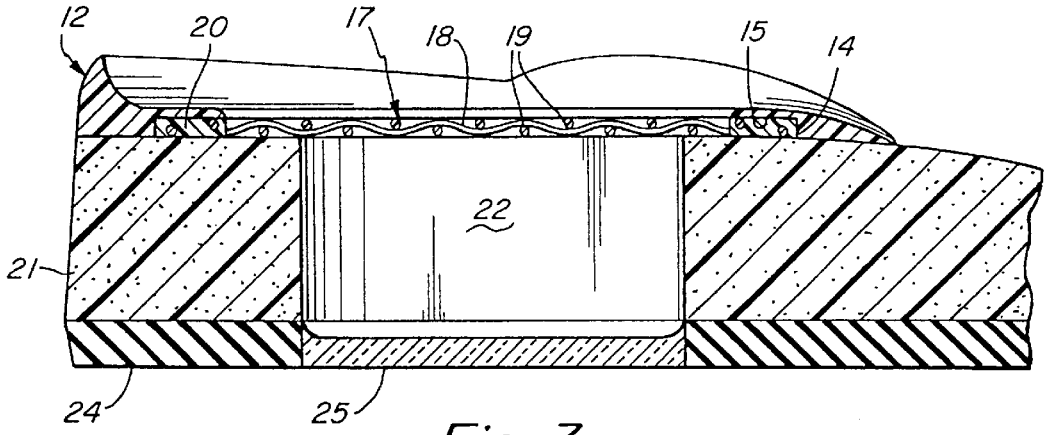
FIG. 3 is a cross-sectional detail taken along the line 3—3 of FIG. 2.
Figure 4:
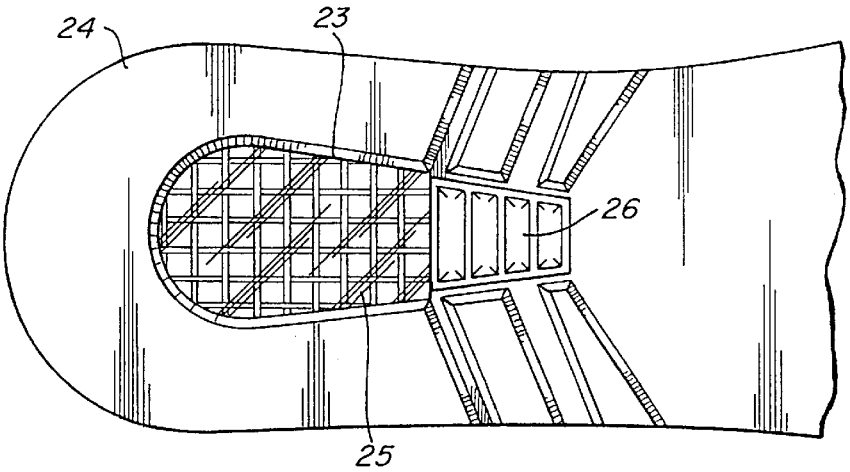
FIG. 4 is a bottom view of FIG. 3.

A grid or net 17 is positioned in and fills the recess 15 to form a continuation and planar member with the base 16. The grid or net 17 is, preferably, integrally molded as an injection molded cassette. This integrally molded grid 17 includes the orthogonally related fibers 18 and 19 which are integrally molded in a taut, planar relation to a peripheral integrally formed peripheral frame 20. This peripheral frame and the grid fibers 18 and 19 form a cassette which is easily positioned in the recess 15. The frame 12 and cassette are positioned over a midsole 21 having an opening 22 in vertical alignment with the grid 17. The shape of the opening 22 may vary depending upon the particular design characteristics desired in the shoe. In the embodiments of FIGS. 2 through 4, the shape, as illustrated in FIG. 4, is roughly a truncated tear-drop shape 23. The size of this opening may be varied. Preferably, it should be large enough to permit easy inspection of the energy return components, but not so large as to affect the mechanical operation of the unit. Accordingly, the largest diameters are preferably somewhat smaller than the opening defined by the frame 20.

The rigid frame 12 is positioned over the midsole 21 in facing relation with it to secure in sandwich relation the cassette between the rigid frame 12 and the upper surface of the midsole 21. The rigid frame 12 cassette and midsole 21 may be suitably secured together in permanent relation by suitable cement or the like.

The lower surface of the midsole is secured to an outer sole 24. The outer sole 24 is also formed with an opening, preferably co-extensive in shape and size to the opening defined in the midsole 21. In a preferred embodiment a transparent plastic window 25 is positioned in the opening defined by the outer sole 24 to form an enclosed space between window 25 and the lower side of the grid or net 17.

The midsole 21 may be formed of a resilient compressible material, such as a microcellular-filled closed cell foam, preferably a polyurethane (PU) or an ethyl vinyl acetate (EVA) material of uniform thickness from the rear of the heel to the toe of the shoe. This midsole may be preferably contoured and shaped. Thus, for example, it may be tapered from a thicker end at the heel to a thin end at the toe, as illustrated in FIG. 2. The compressibility for the midsole depends upon the particular purpose for which the shoe is designed. Thus, for example, it may have a durometer in the order of 30 to 45 Sa. Although the midsole is described as formed of a resilient compressible material of the type conventionally used for midsole constructions, its thickness and or durometer should be sufficient to maintain a void or opening 22 below the grid or net 17 when the shoe is worn. This opening 22 in the midsole beneath the grid or net has a relevant function with respect to cushioning energy return motion control. Its location also assists in stabilizing the foot during gait cycle.

Figure 5:
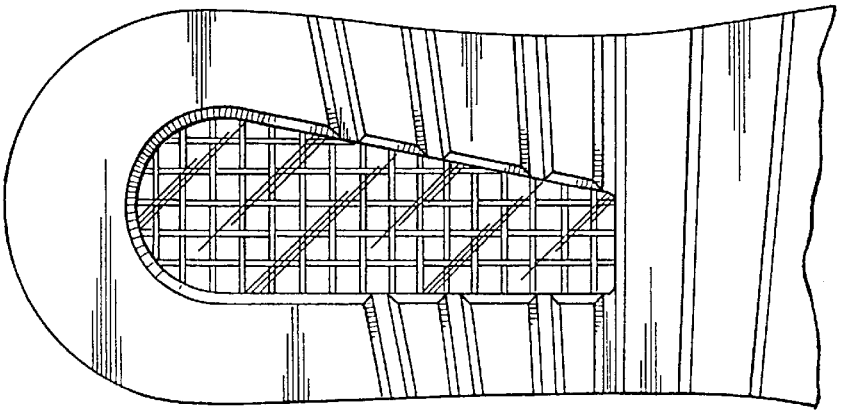
FIG. 5 is a bottom view illustrating another embodiment of the invention.

FIG. 4 illustrates the bottom view of FIG. 3, in which a section of the transparent window 25, as illustrated at 26, is decorative in nature. If desired, however, the opening may be modified in the shape shown in FIG. 5.

Figure 6:
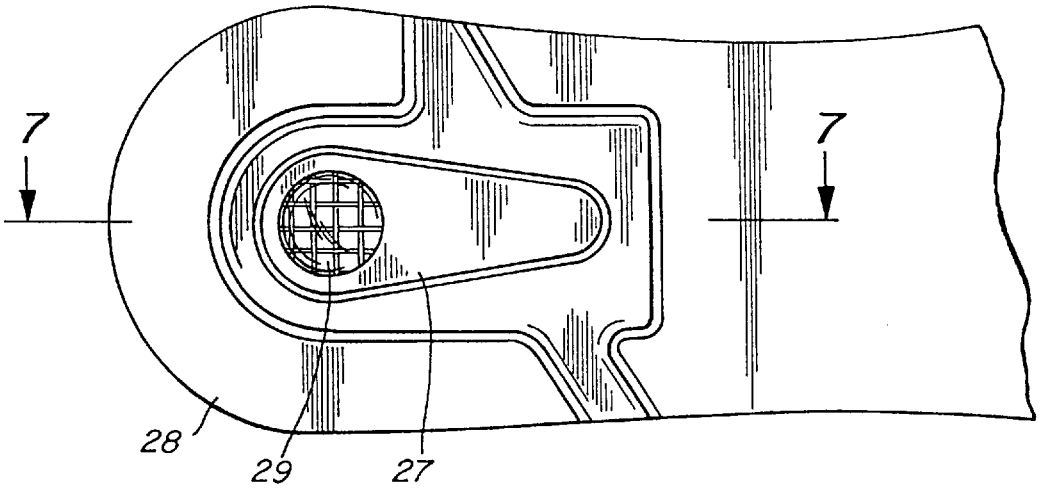
FIG. 6 is a bottom view illustrating yet another embodiment of the invention.
Figure 7:
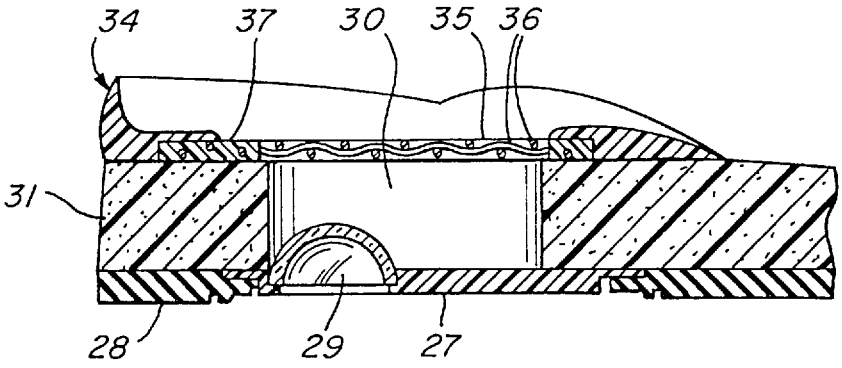
FIG. 7 is a cross-sectional view of a heel component illustrating yet another embodiment of the invention taken along the line 7—7 of FIG. 6.

FIGS. 6 and 7 illustrate a further modification of the invention in which the window 27 is integrally secured in an opening formed in the outer sole 28. This window 27 is provided with a magnifying element 29 in the shape of a dome-like member that projects upwardly into the opening 30 formed in the midsole 31. In this particular embodiment, the rigid frame or stabilizing member 34, is formed similarly to the rigid frame 1 with an opening in which a cassette generally indicated at 35 is located. In this case, the cassette 35 consists of a grid of orthogonally related fibers 36 forming a grid or net that is secured at its periphery in a lamination of annular frame 37. Fibers or filaments 36 may be made of a monofilament of suitable material, such as gut or nylon, and may be strung or woven similar to the arrangement of FIG. 1. Interwoven cross filaments with longitudinally extending filaments are anchored in the annular frame 37.

Having now described my invention, we claim:

1. A shoe structure, comprising: an aligned opening in inner and outer sole members defining a chamber formed by said opening, a transparent magnifying member covering said opening and projecting upwardly within said chamber through which a portion of the chamber may be viewed, an object secured within said chamber distal from said member, said object and said member defining an uncompromised void therebetween, whereby said object is magnified when viewed through said member.

2. The structure as set forth in claim 1, wherein said magnifying member is recessed within said outer sole member.

3. The structure as set forth in claim 1, wherein said magnifying member is formed from a portion of a window secured to said outer sole.

4. The structure as set forth in claim 3, wherein said portion of said window is a dome.

5. The structure as set forth in claim 1, further including a component spaced from said member and proximal to an upper surface of said chamber distal from said member.

6. A shoe structure having a sole member, comprising:

a recess in the sole member defining a chamber in the shoe structure, a transparent magnifying member closing said chamber and through which a component forming at least a portion of a wall of said chamber spaced from said member may be viewed, and whereby said portion is magnified through said member wherein said chamber portion between said component and said member is uncompromised.

7. The structure as set forth in claim 6, wherein said recess extends through the sole.

8. The structure as set forth in claim 6, wherein said component is disposed in facing alignment with said member.

* * * * *